US010875049B2

(12) United States Patent
Anderson

(10) Patent No.: US 10,875,049 B2
(45) Date of Patent: Dec. 29, 2020

(54) CONSTRUCTION MATERIAL MIXING SYSTEM

(71) Applicant: Tomorrow's Tools, LLC, St. Louis, MO (US)

(72) Inventor: Holland M. Anderson, Des Peres, MO (US)

(73) Assignee: Tomorrow's Tools, LLC, St. Louis, MO (US)

( * ) Notice: Subject to any disclaimer, the term of this patent is extended or adjusted under 35 U.S.C. 154(b) by 732 days.

(21) Appl. No.: 15/590,579

(22) Filed: May 9, 2017

(65) Prior Publication Data

US 2017/0333939 A1 Nov. 23, 2017

Related U.S. Application Data

(60) Provisional application No. 62/337,955, filed on May 18, 2016.

(51) Int. Cl.

| | |
|---|---|
| ***B05C 17/005*** | (2006.01) |
| ***B01F 13/00*** | (2006.01) |
| ***B01F 15/00*** | (2006.01) |

(52) U.S. Cl.

CPC ..... *B05C 17/00583* (2013.01); *B01F 13/002* (2013.01); *B01F 15/00006* (2013.01); *B01F 2215/005* (2013.01); *B01F 2215/0047* (2013.01)

(58) Field of Classification Search

CPC ..... B05C 17/00583; B01F 13/002; B01F 15/00006; B01F 2215/0047; B01F 2215/005; B01F 15/00772; B01F 7/00033; B01F 15/029; B01F 7/0005; B01F 15/0085; B01F 7/0015; B01F 13/0028; B01F 7/00291; B28C 5/161; B28C 5/003

USPC ..... 366/275

See application file for complete search history.

(56) References Cited

U.S. PATENT DOCUMENTS 2,719,982 A * 10/1955 Hasselquist ..... A47K 3/02 4/506
2,854,049 A * 9/1958 Spencer ..... A62C 35/02 220/565
4,124,049 A * 11/1978 Yamaguchi ..... B65D 88/1656 220/216

(Continued)

FOREIGN PATENT DOCUMENTS

GB 2319951 A * 6/1998 ..... B01F 15/00019

OTHER PUBLICATIONS

Youtube, How to Mix Quickset Joint Compound by Hand, www.youtubecom/watch?V+vsic-pzg_z0, Published Jun. 28, 2015, 11 Screen Shots of Video.

(Continued)

*Primary Examiner* — Huy Tram Nguyen
(74) *Attorney, Agent, or Firm* — Stinson LLP

(57) ABSTRACT

Systems and methods for preparing construction material mixtures. A container can include a flexible body having an interior for receiving and holding construction material mixture components to be mixed. The construction material mixture components can be mixed in the interior by rotating a mixing tool. The flexible body is collapsible for forcing the construction material mixture out of a mouth of the container. The flexible body can be everted to facilitate cleaning the interior of the flexible body. The system can also include a stand, a mixing tool, a funnel, and/or a measuring cup.

20 Claims, 15 Drawing Sheets

(56) References Cited

U.S. PATENT DOCUMENTS

| | | | | |
|---|---|---|---|---|
| 9,084,971 | B1 * | 7/2015 | Villasenor | B05B 7/2408 |
| 2007/0157513 | A1 * | 7/2007 | Varney | A01G 9/026 47/65.8 |

OTHER PUBLICATIONS

Youtube, How the Pros Mix Drywall Mud and Apply Tape, https//www.youtube.com/watch?_z5it08p01o, Published Apr. 26, 2014, 7 Screen Shots of Video.

* cited by examiner

CONSTRUCTION MATERIAL MIXING SYSTEM

CROSS-REFERENCE TO RELATED APPLICATION

The present application claims priority to U.S. Patent Application No. 62/337,955, filed May 18, 2016, which is hereby incorporated by reference in its entirety.

FIELD

The present disclosure generally relates to construction material, and more particularly to systems for mixing construction material and associated methods.

BACKGROUND

Various types of construction materials require mixing. Common examples of construction materials that require mixing include tile grout, thinset mortar, drywall mud, sand in paint, etc. Various systems and methods are known for mixing such construction materials. However, the conventional methods can be difficult, time consuming, and require substantial time for cleanup.

SUMMARY

In one aspect, a method is for preparing a batch of construction material mixture. The method includes transferring at least one powder construction material mixture component or at least one granular construction material mixture component into an interior of a generally flexible body of a container through a mouth of the container. The interior has a longitudinal axis extending from the mouth to a bottom portion of the flexible body opposite the mouth. The method includes transferring at least one liquid construction material mixture component into the interior of the flexible body through the mouth. The method includes rotating a mixing tool in the interior of the flexible body to mix the construction material mixture components in the interior to form the batch of construction material mixture. The method includes dispensing a portion of the construction material mixture from the flexible body by collapsing the flexible body inward toward the longitudinal axis to decrease a volume of the interior to force the construction material mixture out of the mouth.

In another aspect, a system is for preparing a construction material mixture. The system includes a container including a generally flexible body. The flexible body has an interior for holding construction material mixture components for preparing the construction material mixture. The flexible body has an interior surface at least partially bounding the interior. The flexible body comprises a liquid impervious material constructed to prevent passage of the construction material mixture components through the flexible body. The flexible body has a mouth sized for receiving construction material mixture components into the interior and for dispensing the construction material mixture from the interior. The flexible body has a base section including a bottom portion opposite the mouth. The flexible body has an intermediate section between the base section and the mouth. The interior has a longitudinal axis extending from the mouth to the bottom portion. The flexible body is configurable in a loading configuration in which the mouth is open, the interior surface at least partially bounds the interior, and the interior has a shape and a first volume for receiving the construction material mixture components. The flexible body is sufficiently robust to maintain the mouth open and substantially maintain said shape of the interior when in the loading configuration with the flexible body at rest and the interior empty. The flexible body is sufficiently resilient to substantially regain said shape of the interior from at least one distorted shape of the interior if the flexible body is partially collapsed to the at least one distorted shape when the interior is empty. The flexible body is configurable in a collapsed configuration in which the interior has a second volume less than the first volume for forcing the construction material mixture out of the mouth to dispense the construction material mixture. The flexible body in the collapsed configuration has the base section collapsed toward the longitudinal axis and the intermediate section collapsed toward the longitudinal axis to decrease the interior to the second volume. The flexible body is configurable in an everted configuration in which the interior surface is exposed outside the mouth. The flexible body is sufficiently flexible to permit movement of the interior surface through the mouth to evert the flexible body to the everted configuration. The flexible body is sufficiently flexible to permit movement of the interior surface back through the mouth to revert the flexible body.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
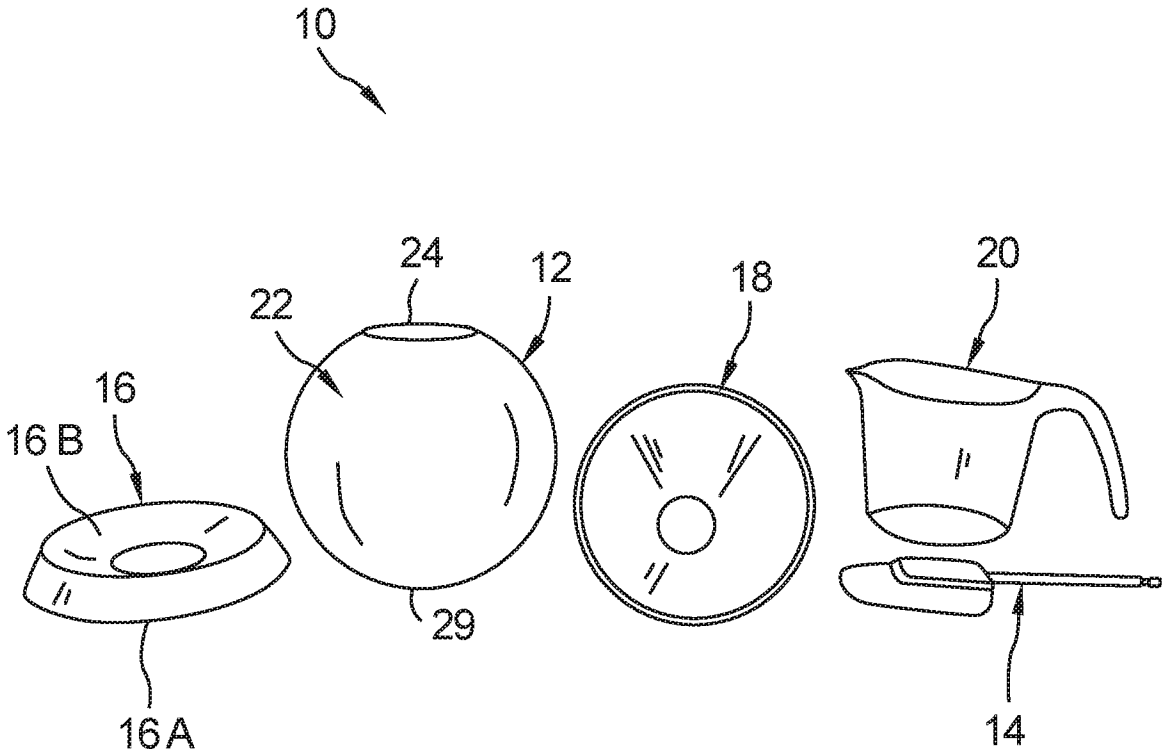
FIG. 1 is a perspective of an embodiment of a system for mixing a construction material mixture.

Referring to FIG. 1, an embodiment of a construction material mixture preparation system is generally designated by the reference number 10. As will become apparent, the system is useful for mixing and dispensing a variety of construction material mixtures. For example, the system 10 can be used for mixing and dispensing construction material mixtures such as drywall mud (drywall compound), tile grout, thinset mortar, or sand in paint. It will be appreciated that the system 10 can be used for preparing other construction material mixtures without departing from the scope of the present invention.

The system 10 can be provided in the form of a kit including, for example, a container 12, a mixing tool 14, a stand 16, a funnel 18, and/or a measuring cup 20. As explained in further detail below, construction material mixture components can be loaded into the container 12 using the measuring cup 20 and optionally the funnel 18. The construction material mixture components are mixed in the container 12 using the mixing tool 14. The stand 16 can be used to support the container 12 in a generally upright orientation while loading and mixing the construction material mixture components. As will become apparent, the system 10 provides a rather convenient and efficient way to mix and dispense construction material mixtures. In particular, the container 12 facilitates easy dispensing of the construction material mixture. The interior of the container is also easily cleanable. One or more of the components of the system 10 can be omitted without departing from the scope of the present invention.

Figure 2:
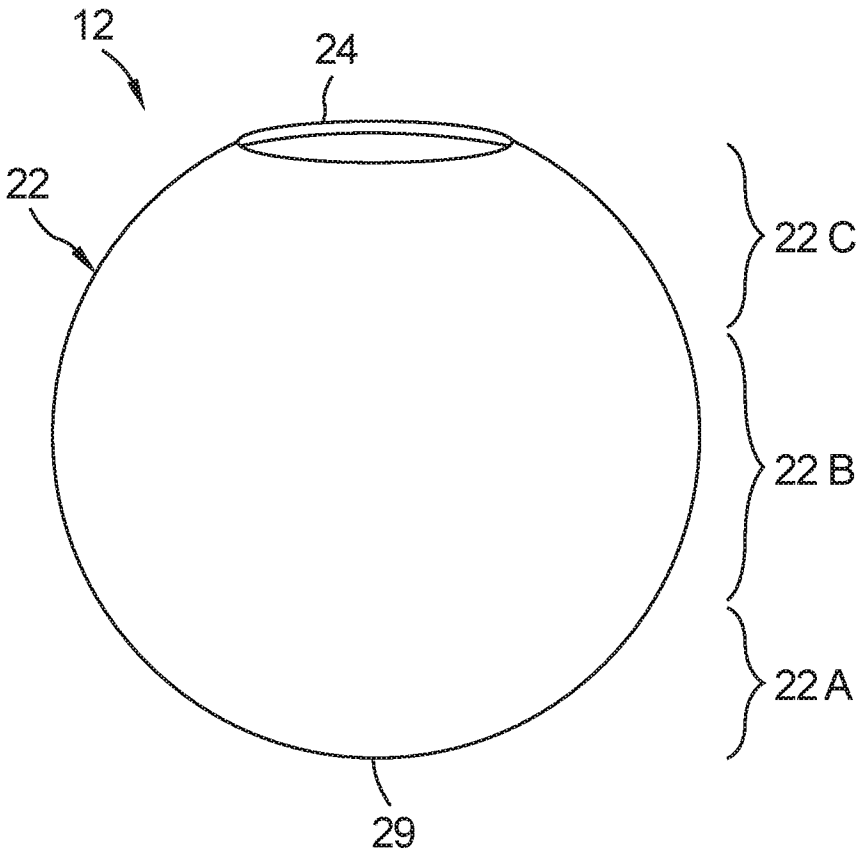
FIG. 2 is a perspective of an embodiment of a container of the system.
Figure 3:
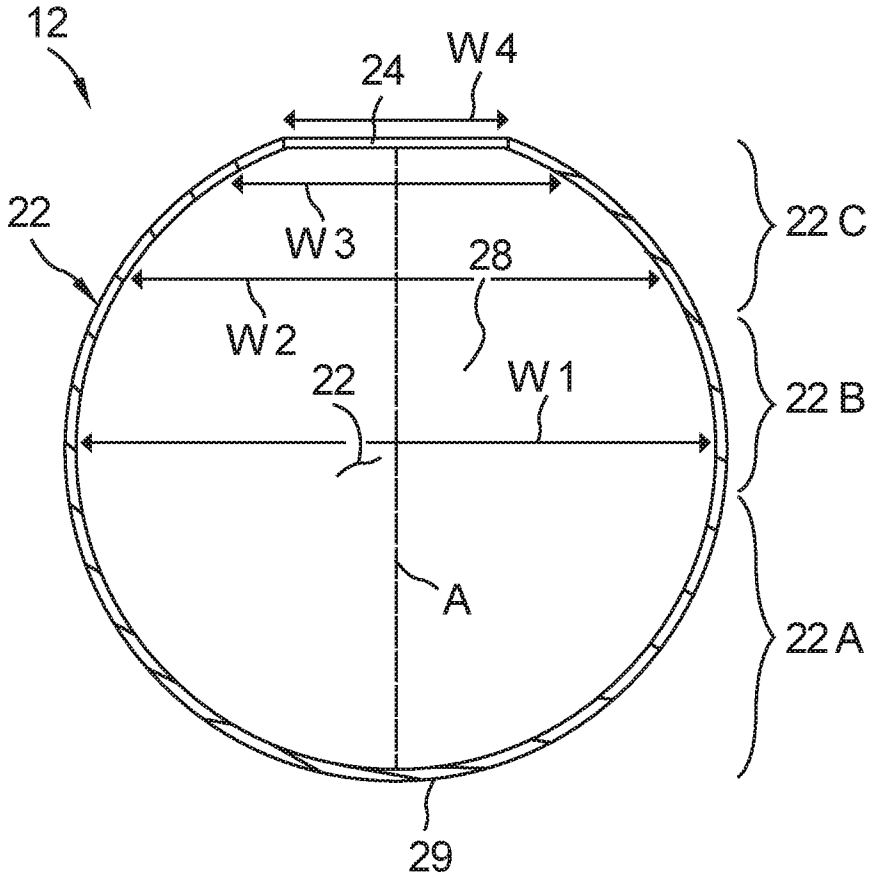
FIG. 3 is a section of the container taken in the plane including line 3-3 in FIG. 2.

Referring to FIGS. 2 and 3, the container 12 includes a flexible body 22 and an opening or mouth 24. In FIGS. 2 and 3, the flexible body 22 is shown in a loading configuration in which the flexible body is at rest. The mouth 24 is provided at a top of the flexible body 22 and permits access to an interior 26 of the flexible body. The flexible body 22 has an interior surface 28 bounding the interior 26. In the illustrated embodiment, the flexible body 22 has a generally hollow spherical construction. The flexible body 22 is desirably formed of a liquid impervious, flexible, and elastic material (e.g., vinyl). The material can have a polished or glossy surface appearance (e.g., on the interior surface 28 and/or outer surface of the body 22). The flexible body 22 has a lower base section 22A, an intermediate section 22B above the base section, and an upper shroud section 22C adjacent the mouth 24. The base section 22A defines a bottom portion 29 of the flexible body 22 opposite the mouth 24. As shown in FIG. 3, a longitudinal axis A of the interior 26 extends from the mouth 24 to the bottom portion 29. The base section 22A, intermediate section 22B, and/or the shroud section 22C by themselves and/or collectively define side portions of the flexible body 22 extending between the bottom portion and the mouth 24. As shown in FIG. 3, the base section 22A increases in width as the base section extends upward from the bottom portion of the flexible body 22. The intermediate section 22B defines a maximum width W1 of the interior 26 at about midway along the height of the flexible body 22. In the illustrated embodiment, the intermediate section 22B increases in width as the intermediate section extends upward from the base section 22A and decreases in width as the intermediate section extends upward toward the shroud section 22C from the maximum width W1. The shroud section 22C decreases in width as it extends upward from the intermediate section 22B toward the mouth 24. The shroud section 22C tapers from a first width W2 to a lesser second width W3 closer to the mouth 24. It will be appreciated that the base section 22A and (optionally with the intermediate section 22B) acts as a bowl for holding the construction material mixture components for mixing, and the shroud section 22C acts as a cover for containing the construction material mixture components in the interior during mixing. As explained in further detail below, desirably one or more of the base section 22A, the intermediate section 22B, the shroud section 22C, and/or the mouth are sufficiently flexible to permit the flexible body 22 to be collapsed and optionally everted.

It will be appreciated that the container 12 can have various sizes without departing from the scope of the present invention. A larger size may be desirable for mixing larger batches of construction material mixture, and likewise smaller sizes may be desirable for mixing smaller batches. For example, the maximum width W1 of the interior 26 can range from about 6 inches to about 24 inches, and the width W4 of the mouth 24 can range from about 3 inches to about 12 inches. Any values within these ranges for W1 and W4 can be used, as well as values outside the ranges, without departing from the scope of the present invention. Broadly speaking, the interior 26 can have a maximum width W1 of at least about 6 inches, at least about 7 inches, or at least about 8 inches, etc., and the mouth 24 can have a width W4 of at least about 3 inches, at least about 4 inches, or at least about 5 inches, etc. The interior 26 can have a maximum width W1 of less than about 24 inches, less than about 20 inches, less than about 18 inches, less than about 14 inches, or less than about 12 inches, etc., and the mouth 24 can have a width W4 of less than about 12 inches, less than about 10 inches, less than about 8 inches, less than about 7 inches, or less than about 6 inches, etc. Desirably, the mouth 24 has a width W4 less than the maximum width W1 of the interior 26. For example, the mouth 24 can have a width W4 at least 25% less than the maximum width W1, at least 35% less than the maximum width, or at least 45% less than the maximum width. In one example, the maximum width W1 is in the range of about 8 inches to about 14 inches, and the width W4 is in the range of about 3 inches to about 10 inches. The following are a few particular examples: 1) width W1 of about 10 inches and width W4 of about 5 inches; 2) width W1 of about 12 inches and width W4 of about 5 inches; 3) width W1 of about 8 inches and width W4 of about 4.5 inches; 4) width W1 of about 11 inches and width W4 of about 5 inches; 5) width W1 of about 12 inches and width W4 of about 6 inches; 6) width W1 of about 20 inches and width W4 of about 9 inches; and 7) width W1 of about 30 inches and width W4 of about 14 inches. Other dimensions and width ratios can be used without departing from the scope of the present invention. For example, the width W4 of the mouth 24 need not be less than the maximum width W1.

The container 12 can have configurations other than described or illustrated herein without departing from the scope of the present invention. For example, the flexible body 22, although generally flexible, can include relatively rigid components. Moreover, other components of the container can also be relatively rigid.

The stand 16 is configured for maintaining the container 12 in an upright orientation while pouring construction material mixture components into the interior 26 and mixing the components. As shown in FIG. 1, the stand 16 includes a bottom 16A configured for engaging a support surface to stabilize the stand on the support surface. The stand includes a cradle 16B configured for cradling the base of the flexible body. In the illustrated embodiment, the cradle 16B defines a recess or seat sized and shaped for receiving the base section 22A of the flexible body. The cradle is desirably made of a material having a sufficient coefficient of friction for supporting the base section 22A against rotation. Although the stand 16 is illustrated as a separate part from the container 12, it will be appreciated that the container can be constructed to include the stand (e.g., at the base of the flexible body 22) without departing from the scope of the present invention.

Figure 4:
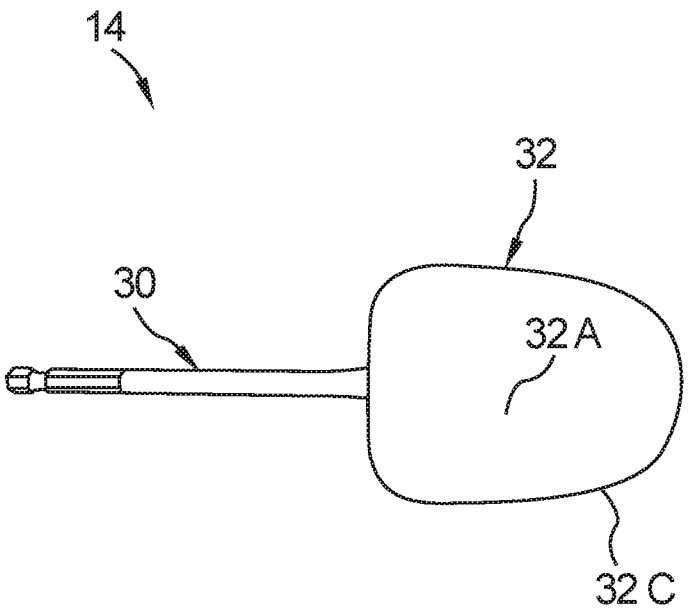
FIG. 4 is a front elevation of an embodiment of a mixing tool of the system.
Figure 5:
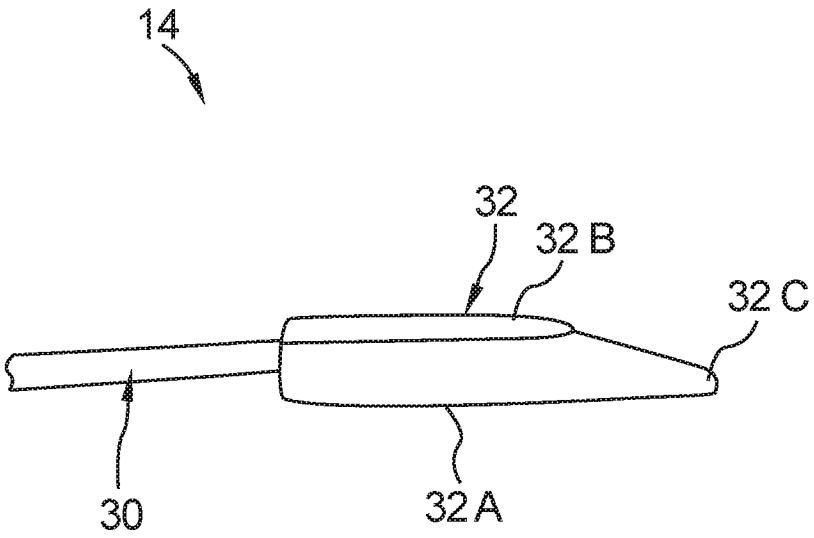
FIG. 5 is a side elevation of the mixing tool.
Figure 6:
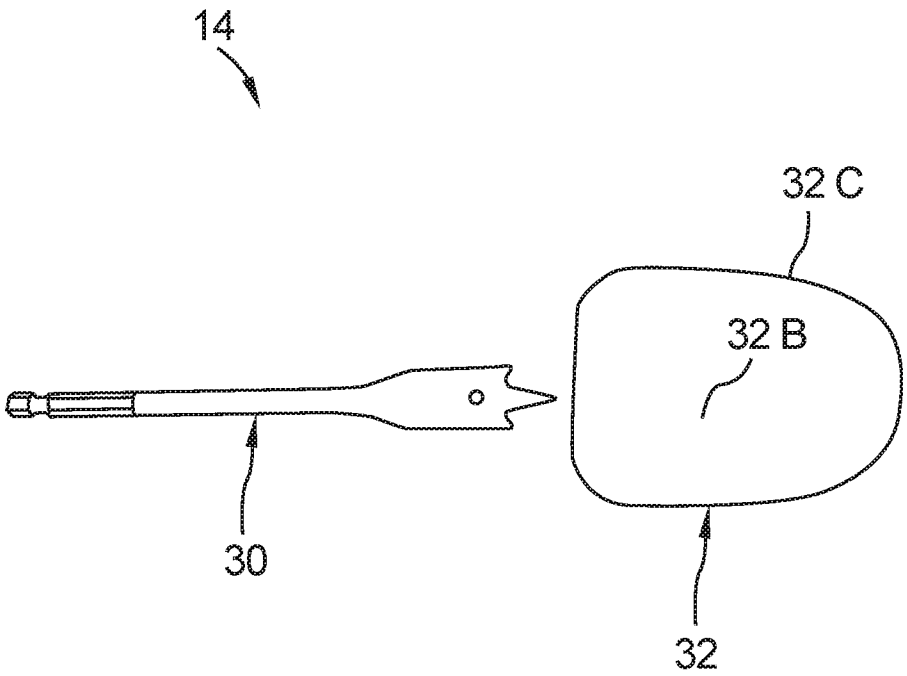
FIG. 6 is an exploded rear elevation of the mixing tool.
Figure 9:
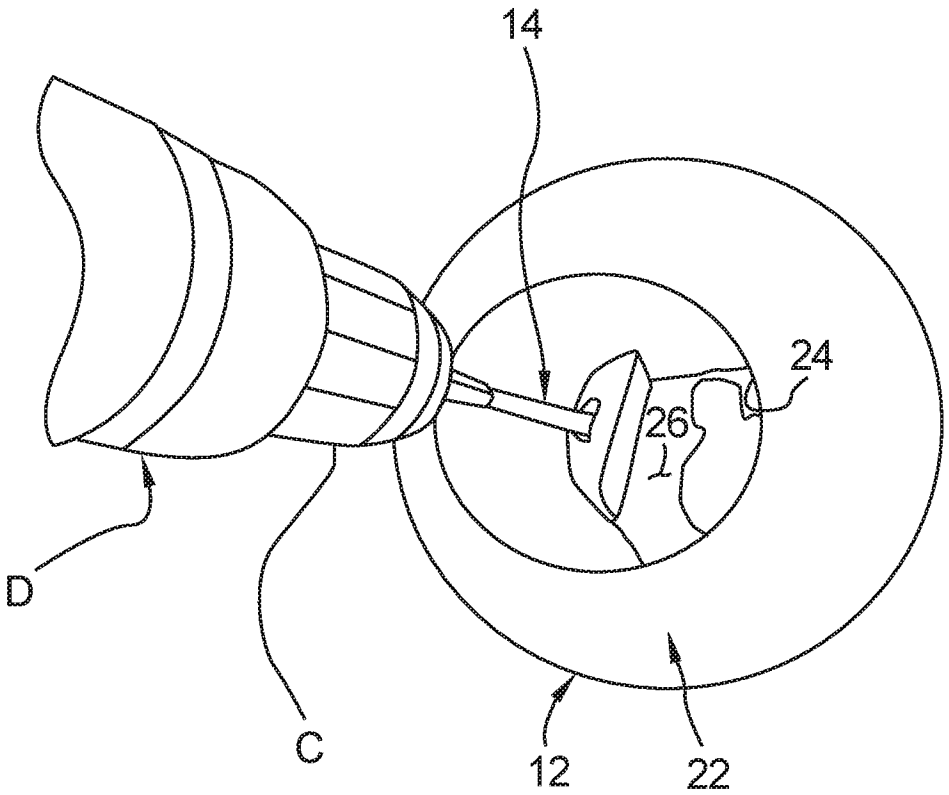
FIG. 9 is a perspective of a drill rotating the mixing tool in the container to mix the construction material mixture components to form a construction material mixture.

As shown in FIGS. 4-6, the mixing tool 14 includes a shaft 30 and a mixing head 32 on an end of the shaft. In the illustrated embodiment, an opposite end of the shaft 30 is configured for mounting in a chuck C of an electric drill D (see. FIG. 9). For example, the end of the shaft 30 opposite the mixing head 32 can have an outer profile (e.g., hexagonal outer profile) sized and shaped for being gripped by the chuck C. The mixing head 32 in the illustrated embodiment comprises a soft flexible paddle. For example, the paddle 32 can be formed of flexible silicone or other suitable material. The paddle 32 has opposite front and rear faces 32A, 32B and a peripheral edge 32C extending around the paddle between the front and rear faces. In the illustrated embodiment, the front face 32A is slightly concave, and the rear face 32B is slightly convex. The peripheral edge 32C is rounded adjacent a distal end of the paddle 32. For example, as shown in FIG. 6, the mixing tool 14 can be manufactured by inserting a head of a spade bit having the shaft 30 into the flexible paddle 32. Thus the shaft 30 is rigid and formed of metal, but other materials can be used.

Figure 7:
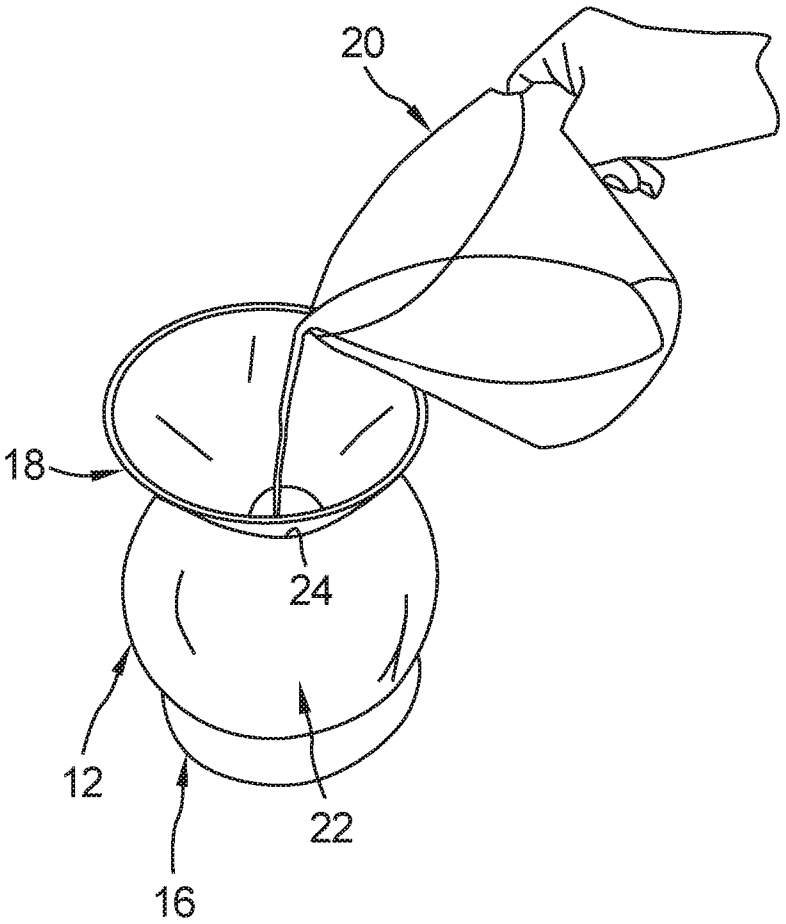
FIG. 7 is a perspective of a liquid construction material mixture component being poured into the container using a measuring cup and a funnel.
Figure 8:
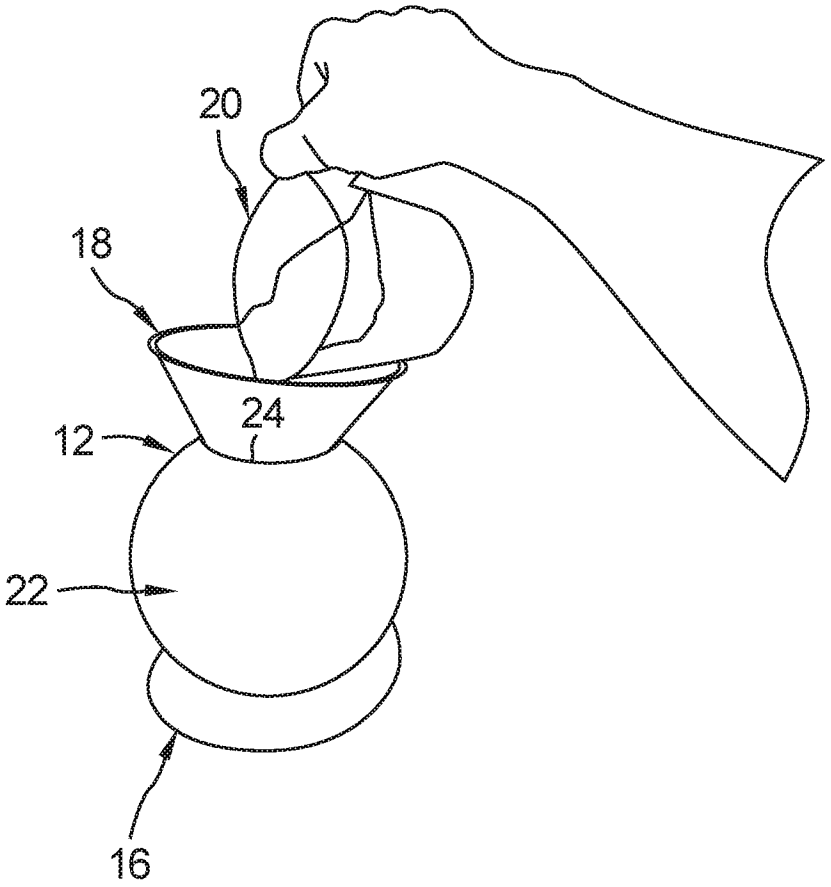
FIG. 8 is perspective of a powder construction material mixture component being poured into the container using the measuring cup and the funnel.

An example method of using the system 10 to prepare a construction material mixture, in this case tile grout, will now be described with reference to FIGS. 7-13. As shown in FIG. 7, the container 12 is positioned on the stand 16 to support the container. The funnel 18 is inserted in the mouth 24 of the container 12 to facilitate transfer of the construction material mixture components into the interior 26 of the container 12. As shown in FIG. 7, a first construction material mixture component, in this case a liquid, is poured into the interior 26 of the container 12 from the measuring cup 20. As shown in FIG. 8, a second construction material mixture component, in this case a grout powder, is poured into the interior 26 from the measuring cup 20. After the mixture components are transferred into the interior 26, the mixing tool 14 is rotated in the interior to mix the components. For example, the electric drill D can be operated at a first relatively slow speed to begin mixing the components, and the electric drill can then be operated at a second relatively fast speed for thoroughly mixing the components into a generally homogenous mixture. It will be appreciated that the flexible paddle 32 rotates in the interior 26 about an axis of rotation defined by the shaft 30. The soft flexible nature of the paddle 32 permits the paddle to temporarily deform when it engages the inside surface of the flexible body 22 and thus assists in preventing damage to the flexible body 22 as the paddle rapidly rotates in the interior. The soft flexible nature of the paddle 32 also assists in wiping the construction material mixture components from the interior surface 28 as the paddle rotates. It will be appreciated that the rounded distal end of the paddle 32 conforms generally to the profile of the interior 26 of the base section 22A and thus facilitates mixing all of the construction material mixture components in the flexible body, even if the mixture components are against the interior surface 28. The interior of the flexible body being free of relatively sharp corners also assists in permitting the paddle in reaching all of the construction material mixture components for mixing them.

Figure 10:
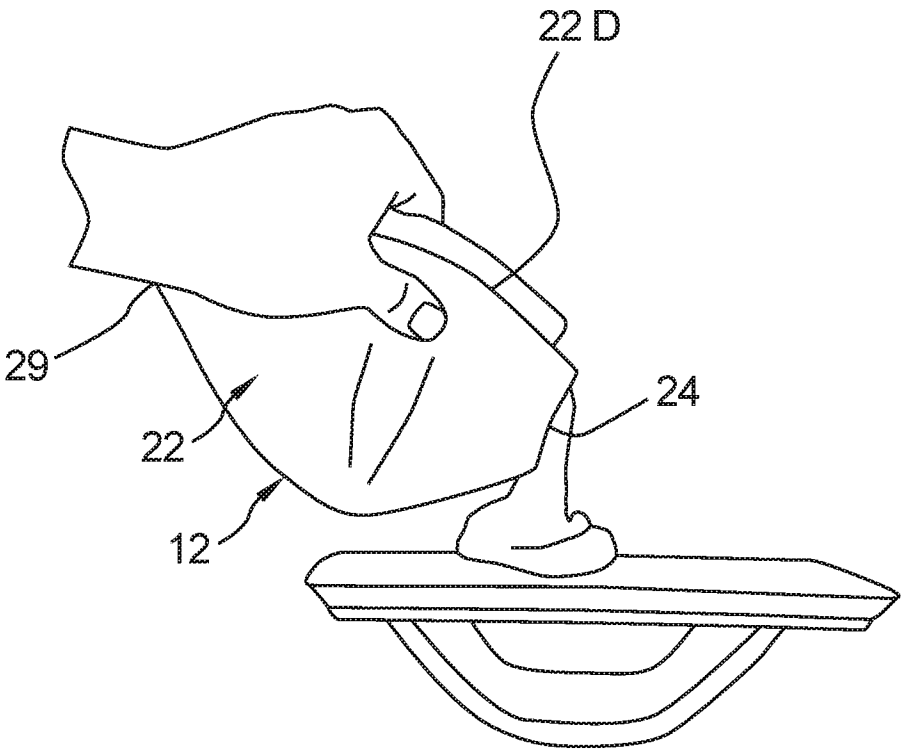
FIG. 10 is a perspective of the container dispensing the construction material mixture onto a float tool.
Figure 11:
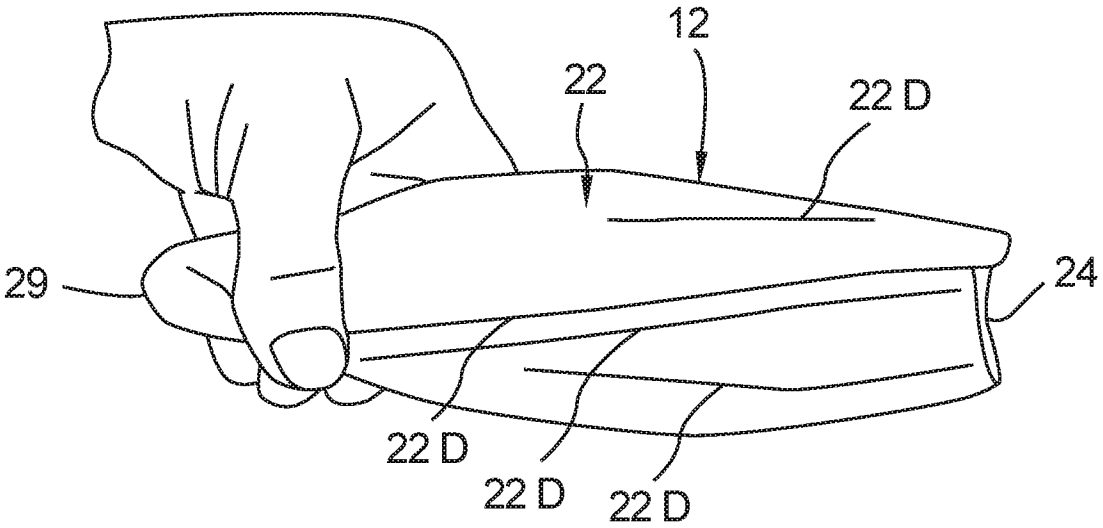
FIG. 11 is a perspective of the container demonstrating a collapsed configuration of the container.
Figure 12:
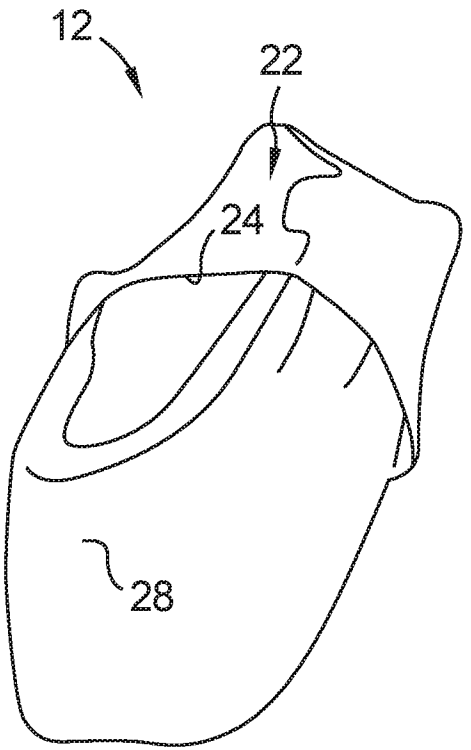
FIG. 12 is a perspective of the container demonstrating a partially everted configuration of the container.
Figure 13:
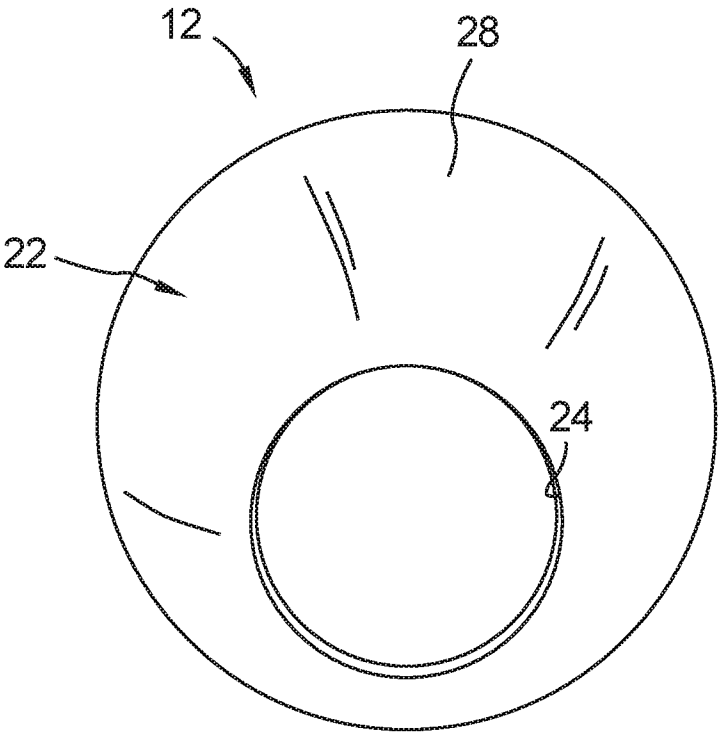
FIG. 13 is a perspective of the container demonstrating a fully everted configuration of the container.

When the construction material mixture has attained a desired consistency, the mixture can be dispensed from the container 12 as shown in FIG. 10. The flexible body 22 is sufficiently flexible to permit the container 12 to be collapsed on itself to a collapsed configuration (e.g., FIG. 10 or FIG. 11) such as by moving side portions of the interior surface 28 toward each other or toward the longitudinal axis A. As side portions of the interior surface 28 move toward the longitudinal axis A, the volume of the interior 26 decreases. As the interior 26 collapses, the interior surface 28 applies pressure to the construction material mixture, which eventually causes the construction material mixture to exit the mouth 24. Accordingly, the flexible body 22 can be collapsed to cause the interior surface 28 to force the construction material mixture out of the mouth 24. As shown in FIG. 11, desirably the flexible body 22 can be collapsed to an extent such that substantially all of the construction material mixture is forced out of the interior 26 through the mouth 24. The flexible body 22 can be collapsed by folding the flexible body to define folds 22D extending generally codirectional (e.g., generally parallel with or along) the longitudinal axis A. For example, one such fold 22D is shown in FIG. 10 and multiple such folds 22D are shown in FIG. 11. It will be appreciated that squeezing and/or twisting the flexible body 22 (e.g., by fingers of a user) can be used to collapse the flexible body 22. In one example, when the flexible body 22 is in a collapsed configuration such as shown in FIG. 11, squeezing the flexible body at the base section 22A (e.g., at the bottom portion 29) and moving the squeezing along the flexible body toward the mouth 24 (e.g., the user sliding their fingers along the flexible body) can push even more of the construction material mixture through the mouth from the interior 26. The flexible body is collapsible such that the length of the interior 26 extending along the longitudinal axis from the mouth 24 to the bottom portion 29 in the collapsed configuration is about the same as or greater than the length of the interior in the loading configuration. The methods described herein for removing construction material mixture from a mixing container are significant improvements compared to conventional methods. The construction material mixture can be dispensed into a separate container, onto an application tool, or directly onto the surface to which the mixture is to be applied.

After the construction material mixture has been dispensed from the flexible body 22, additional batches of the mixture can be prepared and dispensed by repeating the steps above. However, if no additional mixture is required, the container 12 can be cleaned in a relatively simple fashion. Because substantially all of the mixture can be forced out of the container 12 as explained above, there may be very little mixture remaining in the interior 26. In one method of cleaning the container 12, the flexible body 22 is everted (i.e., turned inside-out). Desirably, the flexible body 22 is sufficiently flexible to permit eversion of the flexible body without damaging the flexible body. More specifically, the flexible body 22 can be manipulated to force the interior surface 28 out of the mouth 24 to position the interior surface on the exterior of the container 12. For example, the flexible body 22 is shown in a partially everted configuration in FIG. 12 and in a fully everted configuration in FIG. 13. In an everted configuration, the flexible body 22 can be cleaned by holding the flexible body under running water or wiping it down with a damp towel or cloth. This is a significant improvement over conventional methods for cleaning construction material mixing containers. The interior surface 28 is substantially smooth and easy to wash. When the interior surface 28 is clean, the flexible body 22 can be reverted (i.e., turned right-side-out) by forcing the interior surface back through the mouth 24.

In the event that the user does not clean the container 12 before the mixture remaining in the container hardens, the flexible body 22 provides a simple and convenient way for removing the hardened material and cleaning the interior surface 28. In particular, if the user permits the construction material mixture remaining in the flexible body 22 to harden, the user can collapse the flexible body to crumble the hardened construction material mixture. Collapsing the flexible body 22 not only crumbles the material into smaller pieces but the flexing of the interior surface 28 also tends to break the material free from the interior surface. The crumbled material can be poured out of the mouth 24. The interior surface 28 can then be rinsed with water. If desired, the flexible body 22 can be everted for cleaning as described above.

It will be appreciated that the method can be used for preparing other types of construction material mixtures without departing from the scope of the present invention. Other potential mixtures could include at least one of a liquid component, a paste component, a viscous component, a powder component, and/or a granular component. Some examples of other mixtures include drywall mud, thinset mortar, or sand in paint.

It will be appreciated that although the flexible body 22 is sufficiently flexible to permit collapsing of the flexible body and to permit eversion of the flexible body, the flexible body is desirably also sufficiently robust to maintain a shape of the interior 26 and to maintain the mouth 24 in an open when in the loading configuration and at rest. The thickness of the material used to form the flexible body, the shape of the flexible body, and/or the traits of the material used to form the flexible body, can be chosen or designed to provide this feature. Desirably, the interior 26 retains its shape and the mouth 24 remains open with the flexible body at rest when empty and when mixture components are loaded therein. For example, as shown in FIGS. 2 and 3, when the flexible body 22 is in the loading configuration at rest (e.g., not held in a partially collapsed or fully collapsed configuration), the interior 26 has a generally bulbous shape and the mouth 24 is fully open. The flexible body 22 is resilient such that if the flexible body were forced into some partially collapsed configurations (e.g., slightly deformed by pushing in one or more sides), the flexible body would resiliently expand to its original shape to provide the generally bulbous interior shape and wide mouth. The shape of the interior 26 defines a receiving space for receiving the construction material mixture components for mixing. It will be appreciated that if the flexible body 22 easily collapsed on itself without application of force, it could be difficult to load the components in the interior 26 and mix the components. For example, if the flexible body 22 at rest substantially collapsed on itself, the user may need to hold the flexible body open to open the mouth 24 and define sufficient space in the interior 26 to receive the components to be mixed. In the illustrated embodiment, the flexible body 22 is self-supporting in defining the hollow interior 26 for receiving the components and maintaining the mouth 24 open. In particular, in the illustrated embodiment, the mouth 24 in the at rest configuration has a round shape, but other shapes can be used, and the shape of the interior 26 in the at rest configuration is substantially spherical, but other shapes can be used. For example, bulbous shapes other than spherical shapes can be used and can include generally flat portions but are desirably generally smoothly curving. Bulbous shapes can include various portions, such as a generally cylindrical portion, portions having sidewalls tapering at varying or constant slopes, and/or other configurations. Desirably the interior surface 28 of the flexible body 22 is free of any crevices and relatively sharp corners (e.g., a corner forming an angle of less than 90 degrees, less than 100 degrees, less than 110 degrees, or 120 degrees) to facilitate mixing of all of the construction material mixture components in the interior 26 and facilitate cleaning of remaining construction material mixture from the interior surface. Flexible bodies having other configurations than described and illustrated herein can be used without departing from the scope of the present invention.

Figure 14:
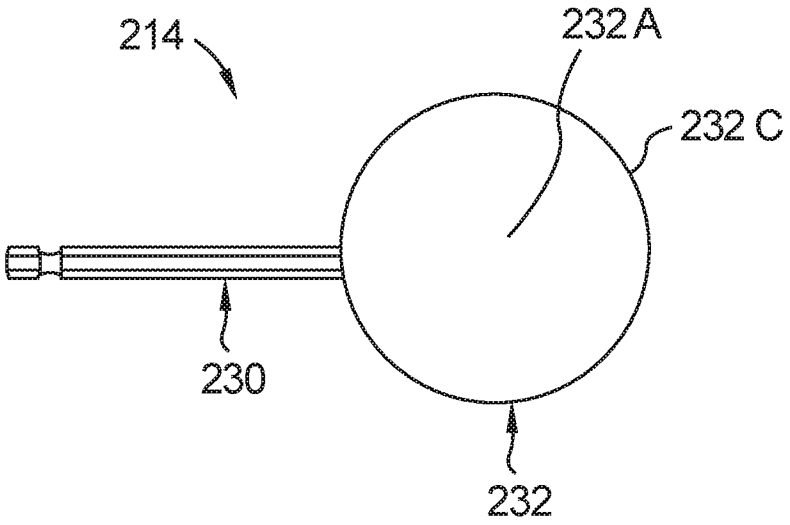
FIG. 14 is a front elevation of a second embodiment of a mixing tool.
Figure 15:
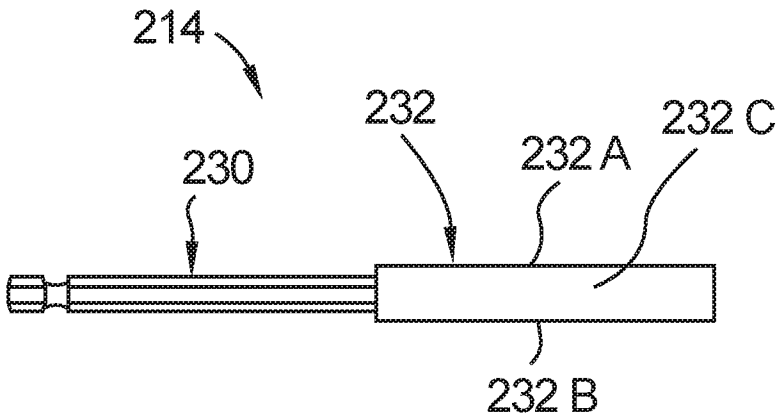
FIG. 15 is a side elevation of the mixing tool of FIG. 14.

FIGS. 14 and 15 illustrate a second embodiment of a mixing tool 114 of the present invention. The mixing tool 114 is substantially similar to the mixing tool 14 described above, and like parts are indicated by like reference numbers, plus 100. For example, the mixing tool 114 includes a shaft 130 and a mixing head 132. The shaft 130 is desirably rigid and can be formed of metal or another suitable material. The proximal end of the shaft 130 is configured for mounting in the chuck C of the electric drill D. The distal end of the shaft 130 is connected to the paddle 132. In this embodiment, the mixing head 132 is a paddle having a generally circular profile. Desirably, the paddle 132 or at least an outer surface of the paddle is formed of soft flexible material, such as silicone. The paddle 132 has opposite front and rear faces 132A, 132B and a peripheral edge 132C extending around the paddle between the front and rear faces. The curves of the peripheral edge 132C provide the paddle 132 with a curved distal end, curved proximal end, and curved sides for conforming generally to the curved interior surface 28 of the flexible body 22. Thus, the respective portions of the paddle 132 are shaped to engage material along the interior surface 28 of the flexible body 22 at the base section 22A, intermediate section 22B, and upper shroud section 22C. Accordingly, the paddle 132 is shaped to facilitate engagement with all of the construction material mixture components, even if the construction material mixture components are in engagement with the interior surface 28. The interior 26 can be referred to as a void of revolution (having a shape formed by revolving a curve about an axis). In the illustrated embodiment, the void of revolution has a generally spherical shape. Desirably, substantially all of or a portion of the paddle 132 is shaped (e.g., the peripheral edge 132C is shaped) such that, when rotated about the axis of the shaft 130, the paddle revolves in a space having a shape smaller than but corresponding generally to the shape of the void of revolution defined by the interior 26.

Having described the construction material mixing systems and methods in detail, it will be apparent that modifications and variations are possible without departing from the scope of the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A system for preparing a construction material mixture, the system comprising:

a container including a generally flexible body, the flexible body having an interior for holding construction material mixture components for preparing the construction material mixture, the flexible body having an interior surface at least partially bounding the interior, the flexible body comprising a liquid impervious material constructed to prevent passage of the construction material mixture components through the flexible body, the flexible body having a mouth sized for receiving construction material mixture components into the interior and for dispensing the construction material mixture from the interior, the flexible body having a base section including a bottom portion opposite the mouth, the flexible body having an intermediate section between the base section and the mouth, the interior having a longitudinal axis extending from the mouth to the bottom portion, the flexible body being configurable in a loading configuration in which the mouth is open, the interior surface at least partially bounds the interior, and the interior has a shape and a first volume for receiving the construction material mixture components, the flexible body being sufficiently robust to maintain the mouth open and substantially maintain said shape of the interior when in the loading configuration with the flexible body at rest and the interior empty, the flexible body being sufficiently resilient to substantially regain said shape of the interior from at least one distorted shape of the interior if the flexible body is partially collapsed to the at least one distorted shape when the interior is empty, wherein when the flexible body is in the loading configuration when the interior is empty and the flexible body is at rest the intermediate section is wider than the mouth and the base section, the flexible body being configurable in a collapsed configuration in which the interior has a second volume less than the first volume for forcing the construction material mixture out of the mouth to dispense the construction material mixture, the flexible body in the collapsed configuration having the base section collapsed toward the longitudinal axis and the intermediate section collapsed toward the longitudinal axis to decrease the interior to the second volume, the flexible body being configurable in an everted configuration in which the interior surface is exposed outside the mouth, the flexible body being sufficiently flexible to permit movement of the interior surface through the mouth to evert the flexible body to the everted configuration, and the flexible body being sufficiently flexible to permit movement of the interior surface back through the mouth to revert the flexible body.

2. A system for preparing a construction material mixture as set forth in claim 1, wherein in the collapsed configuration the mouth is collapsed toward the longitudinal axis.

3. A system for preparing a construction material mixture as set forth in claim 1, wherein in the collapsed configuration the flexible body is folded defining a fold extending generally codirectional with the longitudinal axis.

4. A system for preparing a construction material mixture as set forth in claim 1, wherein the everted configuration is a fully everted configuration in which the interior surface is fully exposed and forms an exterior of the flexible body.

5. A system for preparing a construction material mixture as set forth in claim 1, wherein in the loading configuration the interior has a first length extending from the mouth to the bottom portion along the longitudinal axis, and the interior in the collapsed configuration has a second length extending from the mouth to the bottom portion along the longitudinal axis, the second length being about the same as or greater than the first length.

6. A system for preparing a construction material mixture as set forth in claim 1, wherein in the loading configuration when the interior is empty and the flexible body is at rest the interior has a maximum width transverse to the longitudinal axis and the mouth has a width less than the maximum width.

7. A system for preparing a construction material mixture as set forth in claim 6, wherein the width of the mouth is at least 25% less than the maximum width.

8. A system for preparing a construction material mixture as set forth in claim 7, wherein said flexible body includes a shroud section adjacent the mouth, the shroud section bounding an upper portion of the interior, wherein in the loading configuration when the interior is empty and the flexible body is at rest the shroud section tapers from a first width transverse to the longitudinal axis to a second width transverse to the longitudinal axis closer to the mouth, the second width being less than said first width.

9. A system for preparing a construction material mixture as set forth in claim 1, wherein said shape of the interior in the loading configuration is free of any corners defining an angle less than 110 degrees.

10. A system for preparing a construction material mixture as set forth in claim 1, further comprising a mixing tool having a flexible head, the flexible head being sized for reception in the interior of the flexible body through the mouth, the flexible head being temporarily deformable by engagement of the flexible head with the interior surface of the flexible body.

11. A system for preparing a construction material mixture as set forth in claim 1, wherein said shape of the interior in the loading configuration is free of any corners.

12. A system for preparing a construction material mixture as set forth in claim 11, wherein the shape of the interior in the loading configuration is generally spherical.

13. A system for preparing a construction material mixture as set forth in claim 1, wherein the flexible body has an exterior surface below the mouth that is curved and is free of any corners.

14. A system for preparing a construction material mixture as set forth in claim 1, wherein the flexible body has an exterior surface shaped as a truncated ball.

15. A system for preparing a construction material mixture as set forth in claim 14, wherein the truncated ball shape of the exterior surface is truncated only at the mouth.

16. A system for preparing a construction material mixture as set forth in claim 14, wherein the exterior surface is shaped as a truncated spherical ball.

17. A system for preparing a construction material mixture, the system comprising:

a container including a generally flexible body, the flexible body defining an interior for holding construction material mixture components for preparing the construction material mixture, the flexible body comprising a liquid impervious material constructed to prevent passage of the construction material mixture components through the flexible body, the flexible body defining a mouth sized for receiving construction material mixture components into the interior and for dispensing the construction material mixture from the interior, the flexible body being configurable in a loading configuration in which the mouth is open and the interior has a shape and a first volume for receiving the construction material mixture components, the flexible body being sufficiently resilient to substantially regain said shape of the interior from at least one distorted shape of the interior if the flexible body is partially collapsed to the at least one distorted shape when the interior is empty, wherein in the loading configuration of the flexible body when the interior is empty and the flexible body is at rest the flexible body has a generally spherical shape, the flexible body being configurable in an everted configuration, the flexible body being sufficiently flexible to permit movement of the flexible body through the mouth to evert the flexible body to the everted configuration, and the flexible body being sufficiently flexible to permit movement of the flexible body back through the mouth to revert the flexible body.

18. A system for preparing a construction material mixture as set forth in claim 17, wherein the flexible body is free of any corners below the mouth.

19. A system for preparing a construction material mixture as set forth in claim 17, wherein said shape of the interior in the loading configuration is free of any corners.

20. A system for preparing a construction material mixture as set forth in claim 17, wherein the flexible body has a bottom portion opposite the mouth, the bottom portion having an arcuate shape.

* * * * *